US006328226B1

(12) United States Patent
Goenka et al.

(10) Patent No.: US 6,328,226 B1
(45) Date of Patent: Dec. 11, 2001

(54) NOZZLE ASSEMBLY

(75) Inventors: Lakhi Nandlal Goenka, Ann Arbor; Marc Alan Straub, Dearborn Heights, both of MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/470,136

(22) Filed: Dec. 22, 1999

(51) Int. Cl.[7] ..... B05B 1/28

(52) U.S. Cl. ..... 239/290; 239/291; 239/294; 239/343; 239/424; 239/424.5; 239/427; 239/427.5; 239/429; 239/430

(58) Field of Search ..... 239/8, 290, 291, 239/294, 296, 343, 369, 370, 371, 424, 424.5, 427, 427.5, 429, 430

(56) References Cited

U.S. PATENT DOCUMENTS

| | | | | |
|---|---|---|---|---|
| 2,029,337 | | 2/1936 | Parker . | |
| 2,391,422 | * | 12/1945 | Jackson | 239/427.5 |
| 2,478,557 | * | 8/1949 | Bell et al. | 239/291 X |
| 3,130,910 | * | 4/1964 | Sill | 239/424 X |
| 3,638,865 | * | 2/1972 | McEneny et al. | 239/424 |
| 3,774,846 | * | 11/1973 | Schurig et al. | 239/424.5 X |
| 5,044,559 | * | 9/1991 | Russell et al. | 239/424 X |
| 5,284,554 | | 2/1994 | Datta et al. . | |
| 5,346,134 | * | 9/1994 | Ma et al. | 239/296 X |
| 5,445,185 | | 8/1995 | Watanabe et al. . | |
| 5,545,073 | | 8/1996 | Kneisel et al. . | |
| 5,566,703 | | 10/1996 | Watanabe et al. . | |
| 5,679,062 | | 10/1997 | Goenka et al. . | |
| 5,775,122 | | 7/1998 | Waase . | |
| 5,815,181 | | 9/1998 | Kashino et al. . | |
| 5,836,150 | | 11/1998 | Garcia . | |
| 5,901,908 | | 5/1999 | Goenka et al. . | |
| 5,920,013 | | 7/1999 | Boardman et al. . | |

FOREIGN PATENT DOCUMENTS

| | | |
|---|---|---|
| 0 108 153 | 4/1982 | (EP) . |
| 964404 | 6/1963 | (GB) . |
| 81050 | 4/1956 | (NL) . |

* cited by examiner

*Primary Examiner*—Robin O. Evans
(74) *Attorney, Agent, or Firm*—Visteon Global Tech., Inc.

(57) ABSTRACT

A nozzle 10 including a member 12 which selectively receives a first material 18 and a second material 22, and which selectively atomizes the second material 22 by use of the first material 18. The nozzle 10 further includes a diffuser member 50 which receives the atomized second material 22 and which diffuses the received and atomized second material 22 while substantially, concomitantly, and tangentially applying the first material 18 to the diffused second material 22, thereby allowing the atomized second material 22 to be desirably deposited upon a target location 7 and/or object 9.

10 Claims, 3 Drawing Sheets

NOZZLE ASSEMBLY

FIELD OF THE INVENTION

This invention relates to a nozzle and more particularly, to a nozzle which selectively emits a streaming sheet of material having relatively uniform and/or substantially identical droplets and having substantially no shear or turbulence.

BACKGROUND OF THE INVENTION

Nozzles selectively emit various types of materials, such as and without limitation paint, thereby allowing the selectively emitted material to be placed or deposited upon various objects and/or upon one or more "targeted" locations in some desired pattern and/or concentration. Particularly, the paint or other material is typically atomized by a relatively high velocity stream of gas and these atomized particles or droplets are selectively emitted, along with the gas, from the nozzle and made to selectively impinge upon the targeted location and/or object.

It is oftentimes desirable to cause the deposited material to form or include substantially "well-defined", relatively straight, "crisp", and/or substantially "clean" edges and/or borders in order to allow the deposited material to create an overall aesthetically pleasing appearance and/or to substantially ensure that only portions of the targeted location(s) or object(s) actually receive the emitted material. For example, vehicle paint striping should normally have well defined and relatively straight edges in order to properly enhance the overall appearance of the vehicle. Moreover, vehicle stripping having multi-color (e.g., two or more) paint portions requires the creation of relatively straight edges or substantially "clean breaks" between each of the applied colored materials, in order to provide the desired overall striping appearance.

While prior nozzles and nozzle assemblies selectively emit material and allow the selectively emitted material to be placed upon various objects and/or targeted locations, they do not readily provide these desired well-defined edges due to the creation and/or existence of a relatively turbulent "shear layer" of material which typically occurs at and/or along the edges of the emitted material.

Moreover, the use of relatively viscous materials requires that the atomizing gas be communicated to and traverse within the nozzle at a relatively high speed, thereby causing the atomized material to be emitted from the nozzle at a relatively high speed and requiring a relatively large distance between the nozzle and the targeted area in order to prevent the relatively high-velocity emitted atomized material from "spattering" upon the targeted location or object. This relatively large distance causes the emitted material, emanating from the outlet aperture, to form a general conical shape or pattern having relatively turbulent shear layers at the edges or periphery of the spray pattern, thereby causing the constituent droplets to have a non-uniform velocity emission profile (i.e., the droplets are emitted from the nozzle at non-uniform speeds or velocities), and causing the creation of substantially non-uniform material deposition concentrations upon the targeted location or object. The deposition pattern is also typically distorted and may, in some instances, cause the emitted material to be applied to "non-targeted" portions or objects.

There is therefore a need for a new and improved nozzle which allows material, such as relatively highly viscous material, to be selectively atomized, emitted, and deposited upon a targeted location and/or object; which allows the selectively deposited material to form substantially well-defined and/or substantially "crisp" and/or relatively straight and/or relatively "clean" and even edges; and which allows the deposited material to form and/or to provide an overall aesthetically pleasing appearance, while increasing the likelihood that the material is only placed upon target objects or locations.

SUMMARY OF THE INVENTION

It is a first object of the present invention to provide a nozzle which overcomes some or all of the previously delineated disadvantages of prior nozzles and/or nozzle assemblies.

It is a second object of the present invention to provide a nozzle which overcomes some or all of the previously delineated disadvantages of prior nozzles and nozzle assemblies.

According to a first aspect of the present invention, the nozzle includes a housing having communicating inlet and outlet apertures. A first material is received by the inlet aperture and communicated to the outlet aperture. The nozzle further includes an injector which is disposed within the outlet aperture, which is coupled to the source of a second material, and which selectively injects the second material into the outlet aperture, effective to allow the injected second material to be atomized by the first material. The nozzle further includes a member which is coupled to the housing, which receives the atomized second material, which diffuses the atomized second material as the atomized second material is mixed with the first material, and which emits the diffused atomized second material.

It is a third object of the invention to provide a method for communicating atomized material, which emanates from a nozzle, to a certain targeted location. The method includes the steps of diffusing the atomized material; mixing the atomized material with the second material as the atomized material is being diffused; and communicating the diffused atomized material to the targeted location.

These and other aspects, features, and advantages of the invention will become apparent from a reading of the following detailed description of the preferred embodiment of the invention in combination with the accompanying drawings.

DETAILED DESCRIPTION OF THE PREFERRED EMBODIMENT OF THE INVENTION

Figure 1:
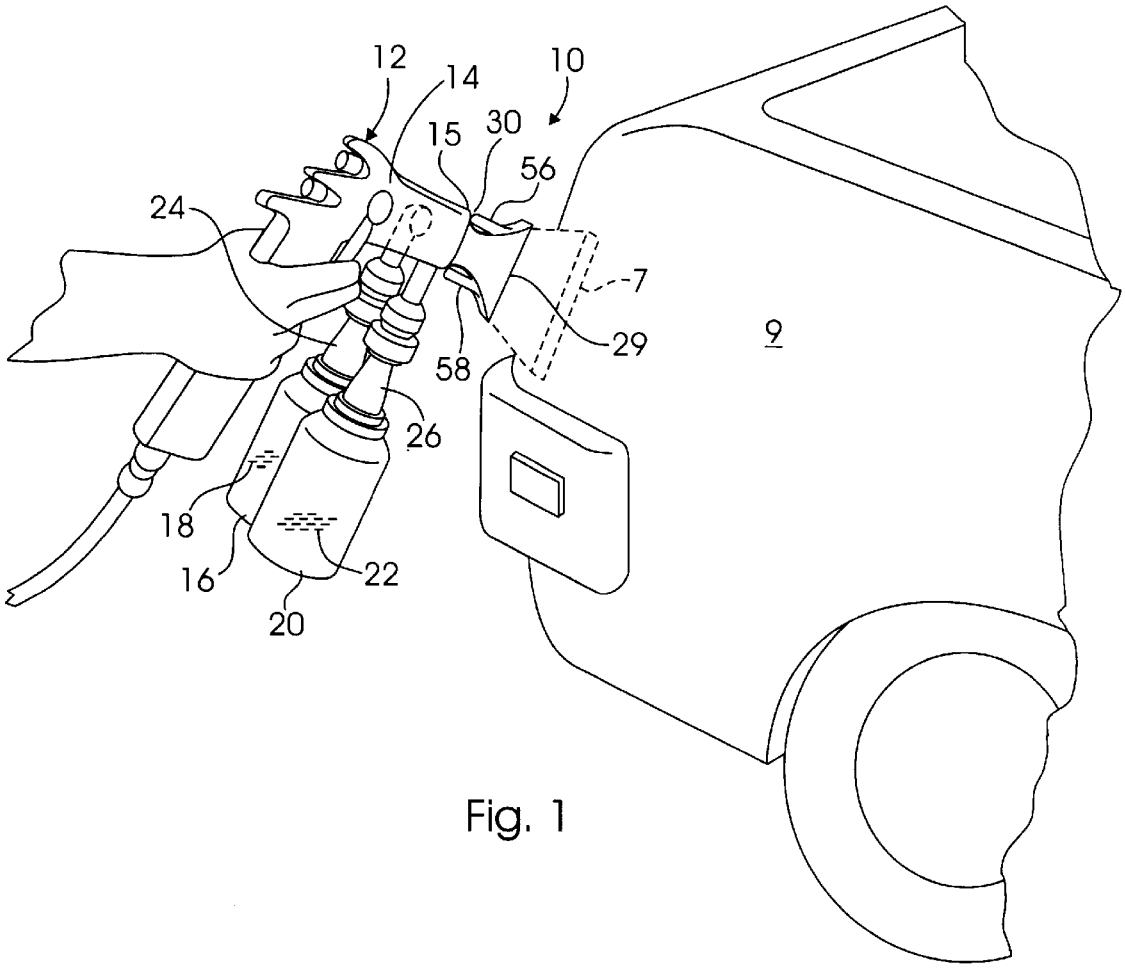
FIG. 1 is a perspective view of a nozzle which is made in accordance with the teachings of the preferred embodiment of the invention and which is operatively deployed upon a spray-gun or material emission device.

Referring now to FIG. 1, there is shown a nozzle assembly 10 which is made in accordance with the teachings of the preferred embodiment of the invention and which is operatively deployed upon a conventional and/or commercially available spray-gun or material emitter 12. As shown, spray gun or material emitter 12 includes a generally hollow body 14 having an outlet aperture 15 which is communicatively and physically coupled to a source 16 of material 18, such as gas. Body 14 is further communicatively and physically coupled to a source 20 of material 22, such as paint or some other type of liquid, such as and without limitation flux, and/or fuel, which is to be atomized and selectively deposited upon a vehicle, such as portion 7 of vehicle 9, or other targeted locations or objects. In one non-limiting embodiment, nozzle 10 and/or various components of nozzle 10 are selectively formed by a silicon micromachining process.

As should be appreciated by those of ordinary skill in the art, gun or emitter 12 selectively causes the materials 18 and 22 to flow through respective tubes or conduits 24, 26 in a conventional and known manner. Particularly, in this embodiment, material 18 is communicated into body 14, by tube 24 and exits body 14 through aperture 15.

Figure 2:
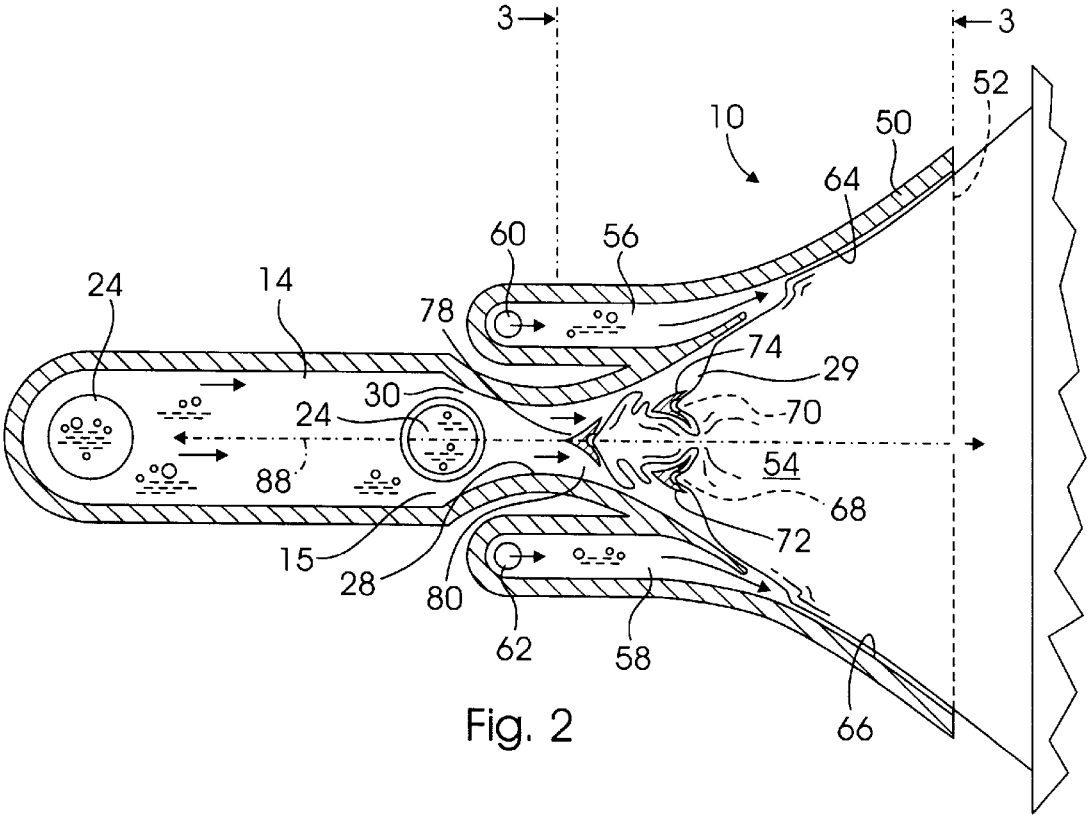
FIG. 2 is a side sectional view of the nozzle which is shown in FIG. 1.
Figure 3:
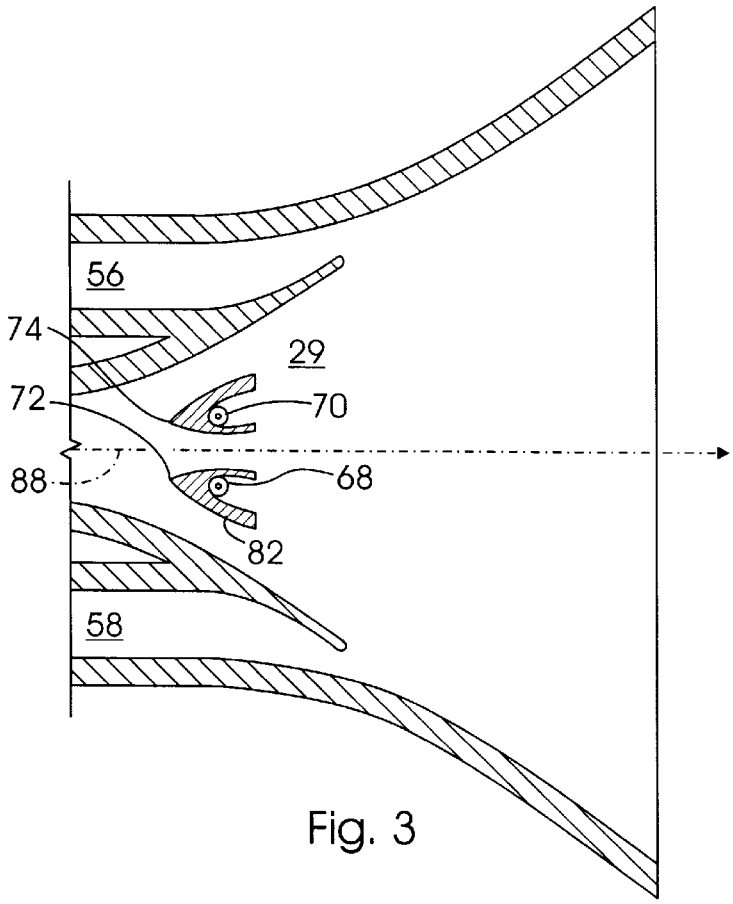
FIG. 3 is an enlarged sectional view of the nozzle which is shown in FIG. 2 and which is taken along line 3—3.
Figure 4:
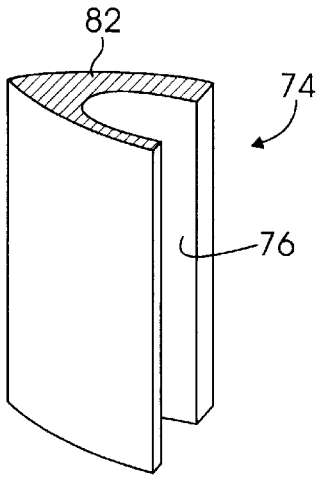
FIG. 4 is a perspective view of an injection member which is shown in FIG. 2 and 3.

As shown best in FIGS. 2 and 3, nozzle 10 includes a first hollow member or portion 28, having an inlet aperture 30 which communicates with the outlet aperture 15 and which cooperates with the outlet aperture 15 to allow gas or other material 18 to enter member or portion 28 through body 14. Member or body 28 may be removably attached to body 14 or may be integrally formed within body 14. Further, member 28 includes an outlet aperture 29.

Assembly 10 further includes a generally hollow and substantially wide-angle diffuser 50 which may be removably coupled and/or connected to member 28 or which may be integrally formed with member 28, and which has a substantially wide outlet aperture 52 and a relatively narrow inlet aperture 54 which is communicatively coupled to the outlet aperture 52. Further, diffuser 50 includes substantially identical and integrally formed, generally hollow, arcuate "sheet" type members or portions 56, 58 which are communicatively and physically coupled, in a conventional manner, to tube 24 by respective tubes or conduits 60, 62, and which provide gaseous material 18 along the tangential edges 64, 66 of the diffuser member 50. In one non-limiting embodiment, tubes or conduits 60, 62 may be attached to a separate source of gaseous material 18.

Further, as shown in FIGS. 2 and 3, material canister 20, by the use of tube or conduit 26, is coupled to tubes or conduits 68, 70 and one open end of these tubes or conduits 68, 70 are respectively disposed within aperture 29. That is, a pair of substantially arcuate or "v"-shaped struts 72, 74 are disposed within aperture 29. Each of the struts 72, 74 has a generally "cupped shaped" or grooved portion 76 which receives and securely positions a respective conduit 68, 70 within the aperture 29. A third strut 78, in another non-limiting embodiment, may be positioned within the throat portion 80 of the member 28 and securely positions, within portion 80, another tube or conduit (not shown) which is also coupled to tube or conduit 26.

In operation, gaseous material 18 is communicated into and supersonically traverses body 14 and enters member 28 through the communicating apertures 15 and 30. The supersonically travelling gaseous material 18 then traverses member 28 and atomizes the injected material 22 which is placed within the aperture 29 by the disposed tubes or conduits 68, 70. Material 22 may also be injected into the throat portion 80 by the disposed tube or conduit present within portion 80. The atomized material 22 then enters the diffuser through the inlet aperture 54 and exits the member 50 through the outlet aperture 52. Within member 50, the atomized material 22 is concomitantly diffused and mixed with gaseous material 18 which is applied to the edges 60, 64 of the diffuser member 50 and to the edges of the diffused atomized material 22 (i.e., the material 18 is tangentially applied to the received atomized material 22).

The diffuser 50 and the tangentially injected gaseous material 18 causes the received atomized material 22 to be deposited in a substantially uniform concentration upon a targeted location 7 or object 9, and substantially prevents the creation of relatively turbulent shear layers which distort the pattern of the applied atomized material 22. Further, it should be realized that the material 22 which is emitted from the injectors 72, 74, and 78 is initially injected in a direction which is substantially parallel to the longitudinal axis of symmetry 88 of member 28. In this manner, the flow of material 18 is not substantially hindered and/or obstructed.

It is to be understood that the invention is not limited to the exact construction and method which has been previously described, but that various changes and modifications may be made without departing from the spirit and the scope of the invention.

What is claimed is:

1. A nozzle having a first portion which receives a first material; and a second diffuser portion which receives said first material from said first portion and which further receives a second material, said diffuser portion further having a pair of substantially identical hollow arcuate sheet portions which receives said first material and which cause said first material to traverse the edges of said diffuser portion and to mix with said second material within said diffuser portion.

2. The nozzle of claim 1 wherein said first material comprises a gas.

3. The nozzle of claim 2 wherein said second material comprises paint.

4. The nozzle of claim 1 further comprising a strut which is disposed within said second diffuser portion and which is coupled to a source of said second material.

5. The nozzle of claim 4 wherein said strut is V-shaped.

6. The nozzle of claim 4 wherein said strut is cupped shape.

7. The nozzle of claim 4 further comprising a second strut which is disposed within said first portion and which is coupled to said source of said second material.

8. The nozzle of claim 7 wherein said first and said second struts are substantially identical.

9. The nozzle of claim 1 wherein said diffuser portion is removably coupled to said first portion.

10. The nozzle of claim 1 wherein said diffuser portion is integrally formed with said first portion.

* * * * *